US006764147B2

(12) United States Patent
Flowers

(10) Patent No.: US 6,764,147 B2
(45) Date of Patent: Jul. 20, 2004

(54) METHOD FOR USING SINGLE PIECE TUB FRAME AND SUPPORT FOR DISHWASHER

(75) Inventor: Christopher L. Flowers, Humboldt, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/397,562

(22) Filed: Mar. 26, 2003

(65) Prior Publication Data

US 2003/0184195 A1 Oct. 2, 2003

Related U.S. Application Data

(62) Division of application No. 09/994,246, filed on Nov. 26, 2001, now Pat. No. 6,666,531.

(51) Int. Cl.[7] ..... A47B 77/06

(52) U.S. Cl. ..... 312/228; 248/677; 248/188.91; 312/236; 134/201

(58) Field of Search ..... 248/188.8, 677, 248/676, 188.91, 672, 316.8, 678; 312/228, 229, 249, 250, 236, 311; 134/200, 201

(56) References Cited

U.S. PATENT DOCUMENTS

| | | | | |
|---|---|---|---|---|
| 3,811,746 A | | 5/1974 | Butsch et al. | |
| 3,822,084 A | | 7/1974 | Brezosky | |
| 3,826,553 A | | 7/1974 | Cushing et al. | |
| 4,164,356 A | * | 8/1979 | Knight | 297/1 |
| 4,295,692 A | | 10/1981 | Jenkins | |
| 4,359,250 A | | 11/1982 | Jenkins | |
| 4,454,732 A | | 6/1984 | Burkland et al. | |
| 4,462,225 A | | 7/1984 | Noe | |
| 4,595,235 A | * | 6/1986 | Leib | 297/294 |
| 4,746,177 A | | 5/1988 | Lampman et al. | |
| 4,758,057 A | * | 7/1988 | Spiegel | 312/249.8 |
| 4,900,109 A | | 2/1990 | Boston et al. | |
| 4,940,298 A | | 7/1990 | Jackson et al. | |
| 5,230,553 A | | 7/1993 | Tuller | |
| 5,613,747 A | | 3/1997 | Becker et al. | |
| 5,741,054 A | | 4/1998 | Becker et al. | |
| 5,758,676 A | | 6/1998 | Duckwall et al. | |
| 5,860,436 A | | 1/1999 | Hobday | |
| 5,992,954 A | | 11/1999 | Becker | |
| 6,045,205 A | | 4/2000 | Dingler | |

* cited by examiner

*Primary Examiner*—Kimberly Wood
(74) *Attorney, Agent, or Firm*—McKee, Voorhees & Sease, P.L.C.

(57) ABSTRACT

A single piece tub support and frame for a dishwasher has a unitary support member that includes a pair of laterally spaced U-shaped upright end portions and an intermediate inverted U-shaped upright portion. The intermediate portion fits over the top and sides of the dishwasher tub rearwardly adjacent the front flange portion thereof. When the U-shaped end portions clear the bottom wall of the tub, they resiliently spring inward into supporting positions under the bottom wall. The unitary support member greatly reduces the number of components required, reduces manufacturing time and cost, and maintains the tub in its designed shape.

1 Claim, 5 Drawing Sheets

METHOD FOR USING SINGLE PIECE TUB FRAME AND SUPPORT FOR DISHWASHER

This application is a division of Ser. No. 09/994,246 filed on Nov. 26, 2001 now U.S. Pat. No. 6,666,531.

BACKGROUND OF THE INVENTION

The present invention relates to the field of dishwashers. More particularly, this invention relates to a single piece frame and support member for the tub of a dishwasher.

A typical dishwasher includes a tub having an open front leading to an interior washing compartment. A door pivotally mounts in a sealable manner over the front opening. Various means have been provided for supporting the tub on a floor or supporting surface. Heretofore tub frame and support means have typically included a plurality of separate component parts that must be welded or fastened together with mechanical fasteners, such as screws, rivets, or the like. Fabrication and assembly of these component parts requires considerable time and effort. It is desirable to minimize the number of component parts, movements, operations, and fasteners that are necessary to assemble the tub support frame, as well as to mount the tub and the door thereto. The component parts must also be assembled in a rather precise manner or distortion of the tub occurs. If the tub walls are not square with each other at the front opening, the door may have difficulty properly sealing the opening.

Therefore, a primary objective of the present invention is the provision of an improved frame and support system for a dishwasher tub.

A further objective of the present invention is the provision of a single piece tub frame and support member that requires no screws, rivets or other mechanical fasteners for its fabrication.

Another objective of the present invention is the provision of a single piece tub frame and support member that elevates the bottom wall of the tub and wraps around the top wall and opposite side walls of the tub to maintain squareness therebetween.

A further objective of the present invention is the provision of a method and means for dishwasher tub and support assembly that is economical, efficient in use, and which results in a reliable and durable assembly.

These and other objectives will be apparent from the drawings, as well as from the description and claims that follow.

SUMMARY OF THE INVENTION

The single piece tub support and frame for a dishwasher has a unitary support member that includes a pair of laterally spaced U-shaped upright end portions and an intermediate inverted U-shaped upright portion. The dishwasher tub attaches to the intermediate portion, which fits over the top and sides of the dishwasher tub rearwardly adjacent the front flange portion thereof. When the U-shaped end portions clear the bottom wall of the tub, they resiliently spring inward into supporting positions under the bottom wall. The unitary support member greatly reduces the number of components required, reduces manufacturing time and cost, and maintains the tub in its designed shape.

DETAILED DESCRIPTION OF THE PREFERRED EMBODIMENT

Figure 1:
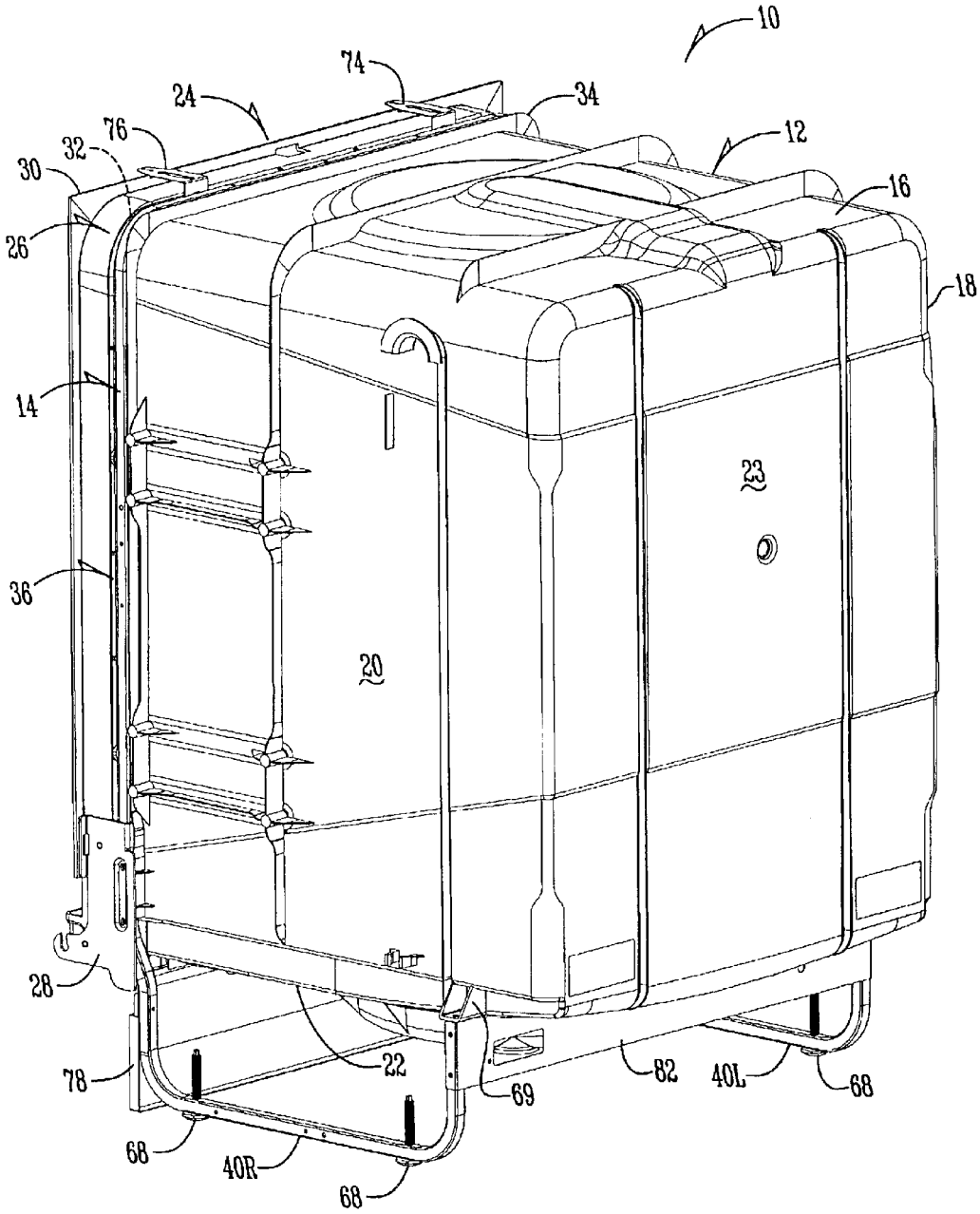
FIG. 1 is a right rear perspective view of a dishwasher tub mounted on the single piece support frame of the present invention.
Figure 2:
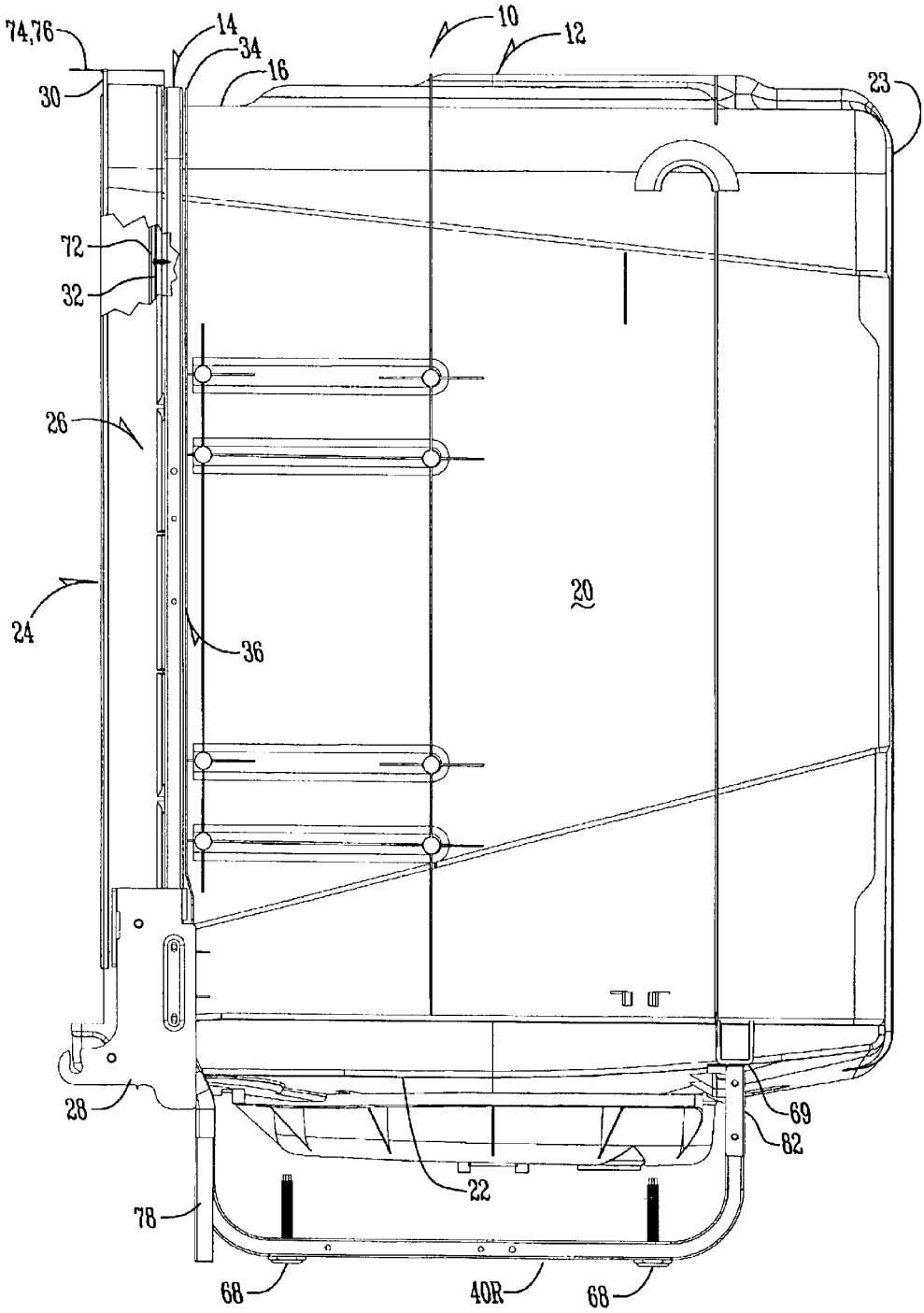
FIG. 2 is a right side elevation view of the dishwasher tub and support frame of FIG. 1.
Figure 3:
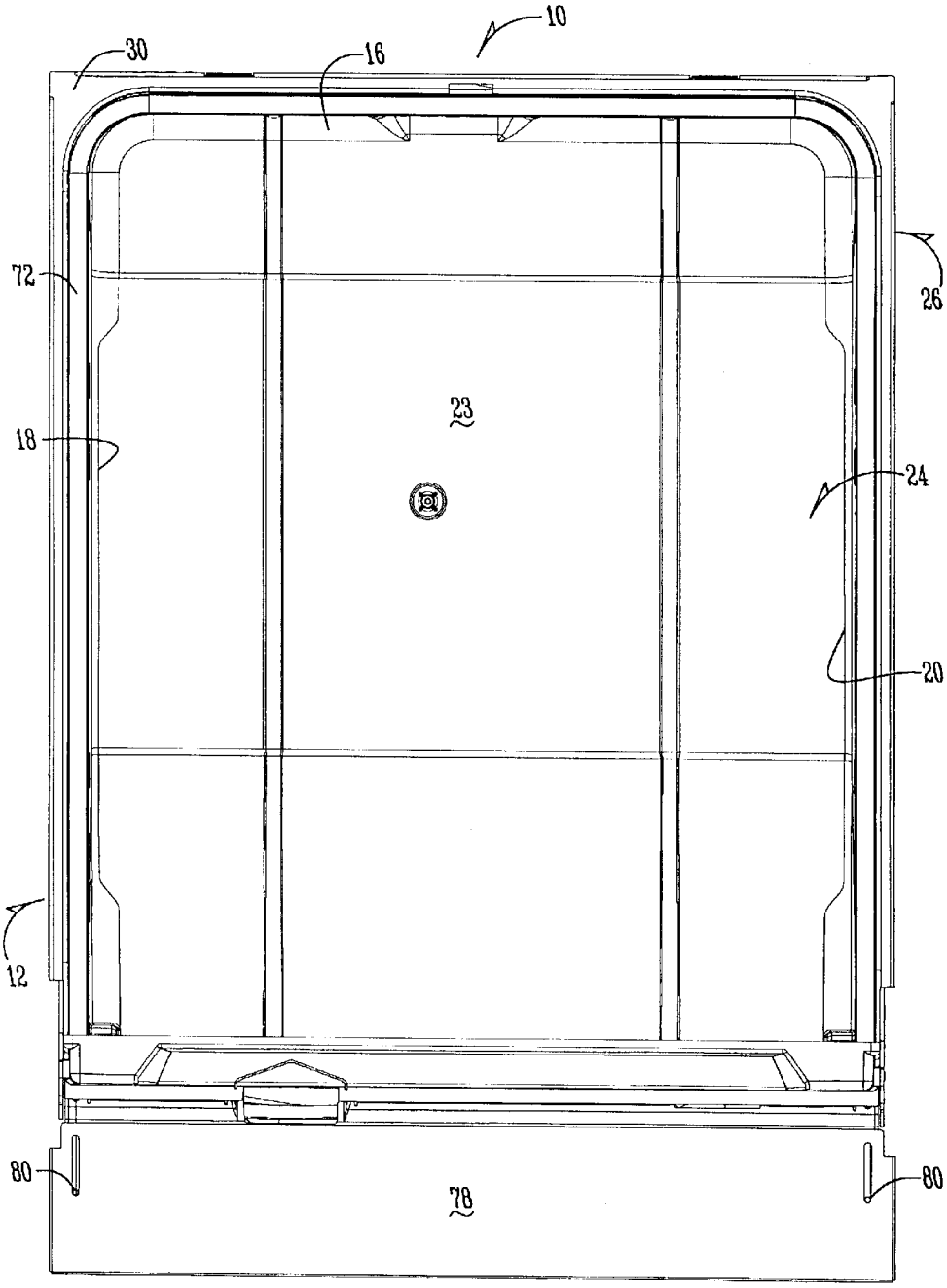
FIG. 3 is a front elevation view of the dishwasher tub and support frame of FIG. 1.
Figure 4:
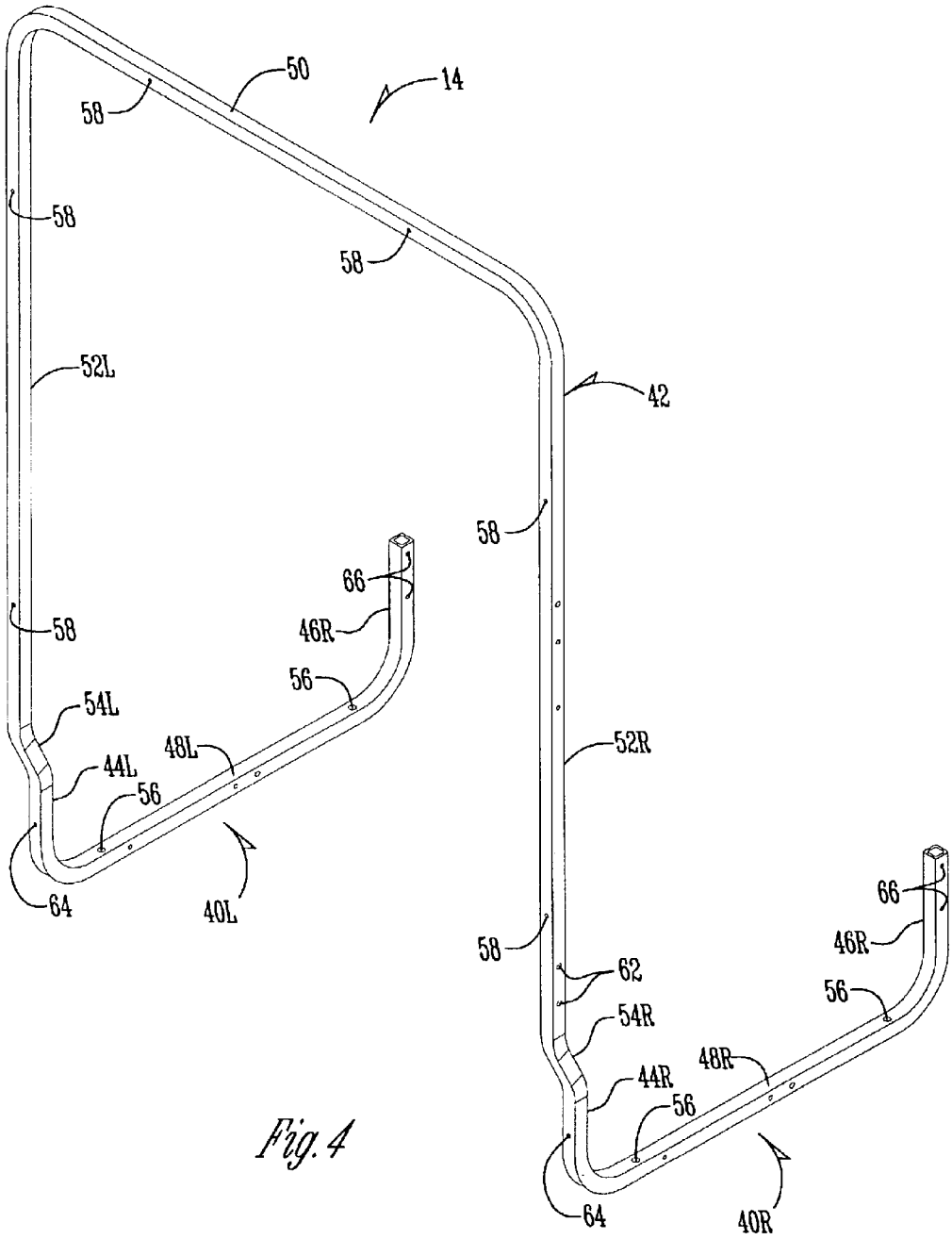
FIG. 4 is a perspective view of the unitary support frame of this invention.
Figure 5:
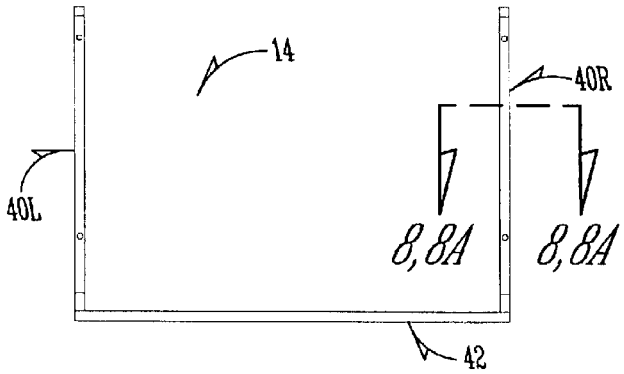
FIG. 5 is a top plan view of the support frame of FIG. 3.

FIGS. 1–3 illustrate a dishwasher tub and frame combination 10 that has a tub 12 supported by a single piece frame and support member 14 according to the present invention. The tub 12 includes a top wall 16, opposite side walls 18, 20, and a bottom wall 22. The tub 12 has a back wall 23 and an open front 24. In the preferred embodiment, the tub 12 is formed of lightweight stainless steel or molded from a plastic material, such as polypropylene, but the materials of the tub can be varied without detracting from the invention.

The tub 12 has a front flange portion 26 for receiving a portion of a door (not shown) that pivotally mounts to the frame and support member 14 at a pair of laterally spaced hinge brackets 28. The front flange portion 26 has a substantially vertical faceplate 30. A recessed substantially vertical surface 32 extends parallel to the faceplate 30 and partially around the perimeter of the open front 24 of the tub 12. More particularly, the surface 32 extends along the top wall 16 and the side walls 18, 20. A guide rib or flange 34 protrudes from the top wall 16 and the opposite side walls 18, 20 generally parallel to the recessed surface 32 and offset therefrom in the direction of the back tub wall 23. Thus, a channel, slot or groove 36 is formed in the tub 12 between the guide rib or flange 34 and the front flange portion 26. The front flange portion 26 and the groove 36 preferably extend perpendicular or square to the bottom wall 22 of the tub 12.

Figure 8:
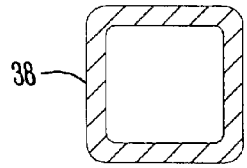
FIG. 8 is a cross-sectional view taken along line 8—8 in FIG. 5 and illustrates an embodiment wherein squire tubing forms the support frame.
Figure 8A:
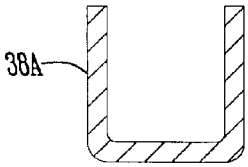
FIG. 8A is cross-sectional view similar to FIG. 5, but shows an alternate embodiment, wherein a U-shaped channel member forms the support frame.
Figure 6:
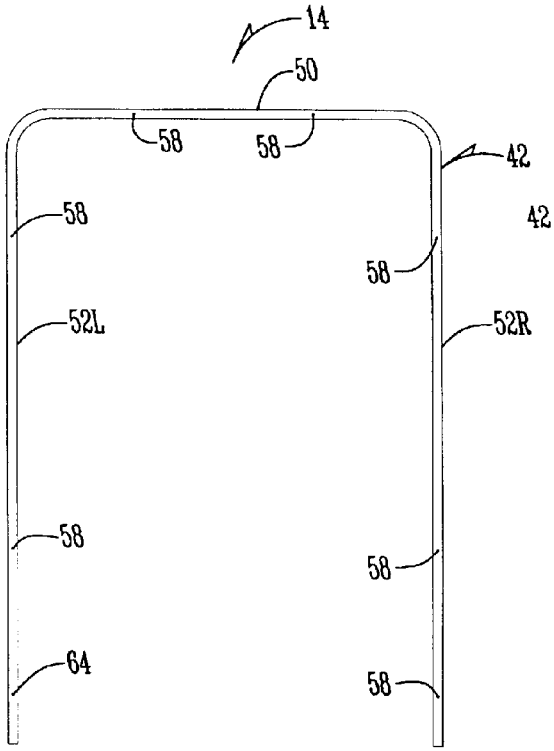
FIG. 6 is a front elevation view of the support frame of FIG. 3.
Figure 7:
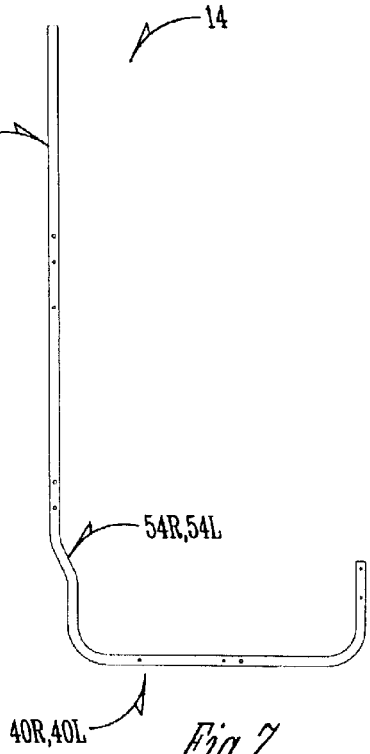
FIG. 7 is a right side elevation view of the support frame of FIG. 3.

Referring to FIGS. 4–8, a single piece of elongated bar stock forms the support member 14. Preferably the bar stock is tubular and has a square transverse cross-section 38, as shown in FIG. 8, or an open channel extending longitudinally therein and a U-shaped transverse cross-section 38A, as shown in FIG. 8A. The preferred materials include steel or aluminum alloys, but the materials can be varied without distracting from the invention. A forming operation results in the support member 14 having a plurality of bends that define several identifiable portions.

In general, the portions of the support member 14 include a pair of laterally spaced upright U-shaped end portions 40L, 4R and an intermediate portion 42 that has an inverted U-shape. The end portions 40L, 40R each have an upright front leg 44L or 44R, an upright rear leg 46L or 46R and a substantially horizontal bottom rail 48L or 48R respectively connecting the legs. The U-shaped end portions 40L, 40R preferably extend parallel to each other and reside in substantially vertical planes.

The intermediate portion 42 has a top rail 50 and side rails 52L, 52R. The exact profile of the inverted U-shaped intermediate portion 42 preferably closely conforms to the outer profile of the tub 12. In the usual case of a rectangular tub, the top rail 50 extends horizontally and the rails 52L, 52R extend vertically. The side rails 52L, 52R are parallel to each other and perpendicular to the top rail 50.

The side rails 52L, 52R are perpendicular to the U-shaped end portions 40L, 40R respectively. The top rail 50 is also perpendicular to the U-shaped end portions 40L, 40R. Thus, the intermediate portion 42 as a whole is perpendicular to and square with the end portions 40L, 40R. The lower ends of the vertical rails 52L, 52R can extend straight down and be directly joined to the front legs 44L, 44R respectively, or optional transition portions or rails 54L, 54R can angle downwardly and rearwardly to provide an indirect connection and recess the end portions 40L, 40R rearwardly from the rails 52L, 52R.

The unitary support member 14 has a plurality of holes 56, 58, 62, 64, 66, that are preferably punched, pierced, or drilled during the forming operation. Longitudinally spaced holes 56 extend vertically through the bottom rails 48L, 48R of the U-shaped end portions 40L, 40R to receive threaded bolts 68 for leveling the tub 12. Holes 58 extend through the intermediate portion 42 of the support member 14. Holes 62 extend laterally into the lower ends of the vertical rails 52L, 52R, preferably just above the transition portions 54L, 54R when those portions exist. Holes 64 extend into the front legs 44L, 44R of the end portions 40L, 40R. Holes 66 extend into the rear legs 46L, 46R of the end portions 40L, 40R.

In use, the support member 14 attaches to the tub 12 in a quick, simple and easy manner. Although the support member 14 is substantially rigid, by design it has some resilient deformability. The worker can pull the end portions 40L, 40R or the lower ends of the intermediate portion 42 farther apart to slip them over the width of the top wall 16. Then the worker moves the member 14 toward the front flange portion 26 and the bottom wall 22 of the tub 12 until the U-shaped end portions 40L, 40R clear the bottom wall 20. At that point, the end portions 40L, 40R resiliently spring back inward into a supporting position under the bottom wall 20 or optional pads 69 attached thereto. The inverted U-shaped intermediate portion 42 will then be securely disposed in the groove 36.

The worker secures the tub 12 to the support member 14 primarily by installing conventional fastening means 70, such as screws in the holes 58. A conventional door seal 72 (FIGS. 2 and 3) mounts on the recessed surface 32 and covers the heads of the screws 70. Cabinet mounting brackets 74, 76 are also attached to the top rail 50 by the screws 70. Door mounting brackets 28 attach to the lower ends of the intermediate portion 42 using holes 62, just above the transition portions 54L, 54R. The optional angled transition portions 54L, 54R, also allow a toe plate 78 to be recessed rearwardly with respect to the front flange 26 of the dishwasher 10. Conventional fastening means 80, such as screws, attach the toe plate 78 at the holes 64 in the front legs 44L, 44R of the end portions 40L, 40R. An optional rear support cross member 82 laterally interconnects the rear legs 46L, 46R of the end portions 40L, 40R to provide additional rigidity to the frame and provide a means for securing the rear legs 46L, 46R to the pads 69.

The single piece support member 14 can be formed in a single forming operation, thereby eliminating a number of machining operations for separate components parts and the sub-assembly thereof. Furthermore, the support member 14 has the added benefit of insuring the squareness of the tub 12 while supporting it. The front flange portion 26 of the tub is directly secured to the intermediate portion 42 of the support member 14. By supporting the tub 12 at the front flange portion 26, door seal problems have been substantially reduced or eliminated altogether.

Thus, it can be seen that the present invention at least satisfies its stated objectives.

In the drawings and specification, there has been set forth a preferred embodiment of the invention, and although specific terms are employed, these are used in a generic and a descriptive sense only and not for the purposes of limitations. Changes in the form and the proportional parts as well as in the substitution of equivalence are contemplated as circumstances may suggest or render expedient without departing from the spirit or scope of the invention as further defined in the following claims.

What is claimed is:

1. A method of assembling a dishwasher tub to a support frame comprising the steps of:

providing a substantially rigid support member having a pair of laterally spaced upright U-shaped end portions for supporting a bottom wall of the tub and an inverted U-shaped upright intermediate portion for extending laterally across a top wall of the tub and downward along opposite side walls of the tub, and the upright U-shaped portions and the inverted U-shaped portion being formed from a single continuous piece of tubular material;

pulling the laterally spaced upright U-shaped end portions of the support frame away from each other sufficiently to receive the top wall and side walls of the tub therebetween; and forcing the support member downwardly toward the bottom wall until the end portions extend beyond the bottom wall and resiliently spring laterally inward toward each other to support the bottom wall.

* * * * *